United States Patent [19]

Fukushima et al.

[11] Patent Number: 4,487,248

[45] Date of Patent: Dec. 11, 1984

[54] SCROLL MANUFACTURING METHOD AND TOOL

[75] Inventors: Eiji Fukushima, Fujimi; Seiichi Fukuhara, Takasaki; Masaharu Hiraga, Honjo, all of Japan

[73] Assignee: Sanden Corporation, Gunma, Japan

[21] Appl. No.: 401,221

[22] Filed: Jul. 23, 1982

[51] Int. Cl.[3] ..... B22D 33/04

[52] U.S. Cl. ..... 164/131; 164/137; 164/342

[58] Field of Search ..... 164/137, 342, 131, 47; 249/59

[56] References Cited

U.S. PATENT DOCUMENTS 801,182 10/1905 Creux ..... 418/6

*Primary Examiner*—Kuang Y. Lin

*Attorney, Agent, or Firm*—Banner, Birch, McKie & Beckett

[57] ABSTRACT

A method and tool for manufacturing a scroll for use in a scroll type fluid displacement apparatus is disclosed. The method, which uses the tool of the present invention, comprises the steps of: (a) providing a tool formed by a mold including a first molding member having a first involute element and an end plate having a plurality of arc shaped holes; a second involute element rotatably coupled to the first molding member through a plurality of pins axially projecting from an axial end surface thereof, the first and second involute elements forming a radial gap; a rotatable member disposed along the end surface of the end plate of the first involute element and coupled to the pins of the second involute element to transmit the rotation thereof to the second involute element; and a second molding member to cover the open end of the radial gap, the second molding member having an indentation facing and in communication with the open end of the radial gap; (b) filling the radial gap between the first and second involute elements and the indentation with molten metal to form the molten metal into the shape of the spiral element and end plate of the scroll, (c) rotating the rotatable member to enlarge the radial gap after the molten metal solidifies; and (d) removing the scroll formed in the radial gap and the identation from the first molding member.

8 Claims, 8 Drawing Figures

SCROLL MANUFACTURING METHOD AND TOOL

BACKGROUND OF THE INVENTION

This invention relates to a scroll type fluid displacement apparatus, and more particularly, to a method for manufacturing the scroll and a tool used in the method.

Scroll type fluid displacement apparatus are well known in the prior art. For example, U.S. Pat. No. 801,182 (Creux) discloses a device including two scrolls, each having a circular end plate and a spiroidal or involute spiral element. Both scrolls are maintained at an angular and radial offset so that both spiral elements interfit to make a plurality of line contacts between their spiral curved surfaces to thereby seal off and define at least one pair of fluid pockets. The relative orbital motion of the scrolls shifts the line contacts along the spiral curved surfaces and, as a result, the volume of the fluid pockets changes. Since the volume of the fluid pockets increases or decreases dependent on the direction of orbital motion, scroll type fluid displacement apparatus are applicable to compress, expand or pump fluids.

FIG. 1 of the drawings illustrates a basic design of a scroll suitable for use in a scroll type fluid displacement apparatus. Scroll 1 includes circular end plate 2 and a wrap or involute spiral element 3 affixed to or extending from one end surface of circular end plate 2. A scroll type fluid displacement apparatus includes a pair of such scrolls which are maintained at an angular and radial offset so that they interfit to form a plurality of line contacts to define at least one pair of fluid pockets. In such apparatus, each sealed off fluid pocket is defined by the line contacts between interfitting spiral elements and the axial contacts between the axial end surface of each spiral element and the inner end surface of the end plate of the other scroll. Thus, the volume of the fluid pockets is defined by the line contacts and the axial contacts.

The scroll is generally formed from pieces of metal by a machining process, such as milling. However, a milling process not only consumes a great deal of time and energy, but also produces large quantities of waste metal. If the scroll is formed by casting or forging, in the event the axial dimension of the spiral element must be made relatively long to obtain a large volume of high capacity, then the draft angle of the mold must be large. After the scroll is formed in such a mold, the spiral element must be machined to obtain uniform wall thickness which again results in relatively large quantities of waste metal. The latter manufacturing method also consumes a great deal of time and energy and this method makes it difficult to attain high accuracy of the wall dimensions of the spiral element.

SUMMARY OF THE INVENTION

It is a primary object of this invention to provide an improved manufacturing method for a preformed scroll which is used in a scroll type fluid displacement apparatus.

It is another object of this invention to provide a manufacturing method for a preformed scroll which can reduce the production of waste metal during the finishing or final machining of the scroll.

It is still another object of this invention to provide a manufacturing method for a preformed scroll which can be used in mass production.

It is further a primary object of this invention to provide a manufacturing tool for forming a preformed scroll which is used in a scroll type fluid displacement apparatus.

It is another object of this invention to provide a manufacturing tool which can be used to achieve dimensional accuracy in the finishing or final machining of the scroll in a time efficient manner.

A method for manufacturing a scroll for use in a scroll type fluid displacement apparatus according to this invention includes providing a first molding member which has an end plate, a first involute element extending from one end surface of the end plate and a plurality of arc shaped holes along the outer side wall of the first involute element. A second involute element is rotatably coupled to the first molding member at a predetermined radial gap. The second involute element has a plurality of pins projecting axially from one axial end thereof for penetrating the arc shaped holes of the first molding member. A rotatable member is coupled to the pins of the second involute element to transmit the rotation thereof to the second involute element. The molding metal which forms the spiral element of the scroll fills the radial gap defined by the inner side wall of the first involute element and the outer side wall of the second involute element. After the metal forms or hardens in the radial gap, the rotatable member is rotated to slightly enlarge the radial gap in order to break any bonds between the formed metal and the first molding member and the second involute element so that the formed metal can be easily removed from the radial gap.

Another aspect of this invention is to provide a second molding member which has a circular indentation in one axial end surface. The second molding member is secured on the end surface of the first molding member to cover the first and second involute elements. The space provided by the indentation comprises a forming space. The metal which fills this forming space forms the end plate of preformed scroll.

A manufacturing tool for use in the above method includes a first molding member with a first involute element, a separate second involute element, a rotatable member and a second molding member. The first molding member includes an end plate, the first involute element and a tubular outer side wall. The first involute element extends from one end surface to the end plate. The tubular side wall also extends from one end surface of the end plate to enclose the first involute element. The end plate has a plurality of arc shaped holes which are located along the outer side wall of the first involute element. The outer and inner side walls of the arc shaped holes consist of arcs, the centers of which are concentric with the center of the first involute element. The second involute element has a plurality of pins extending from one axial end surface. The pins extend through the holes in the end plate of the first molding member so that the second involute element interfits the first involute element at a predetermined radial gap. The rotatable member has a plurality of holes into which the axial end portion of the pins fit. The radial gap between the inner side wall of the first involute element and the outer side wall of second involute element defines the forming space within which the spiral element of the preformed scroll is formed. The second molding member is placed on the first molding member and connected to the first molding member when casting the molten metal.

In accordance with the present invention, the forming space between the first and second involute elements can be enlarged because the involute elements can be rotated relative to each other. Also, the removal of the preformed scroll from the first molding member can be accomplished by a simple process because these involute elements can be rotated relative to each other.

Further objects, features and other aspects of this invention will be understood from the following detailed description of the preferred embodiment of this invention referring to the annexed drawings.

DETAILED DESCRIPTION OF THE PREFERRED EMBODIMENT

Before the preferred embodiment of this invention is described, the principle properties of involute contours, which are used to form spiral elements for scroll type fluid displacement apparatus, will be described with reference to FIGS. 2–4.

Figure 1:
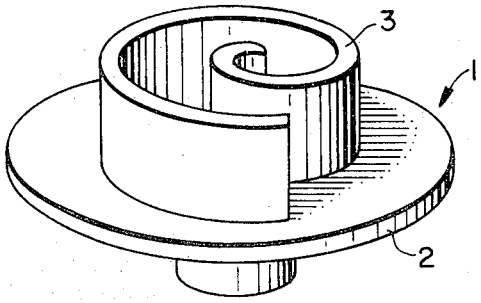
FIG. 1 is a perspective view of a scroll for use in a scroll type fluid displacement apparatus.
Figure 2:
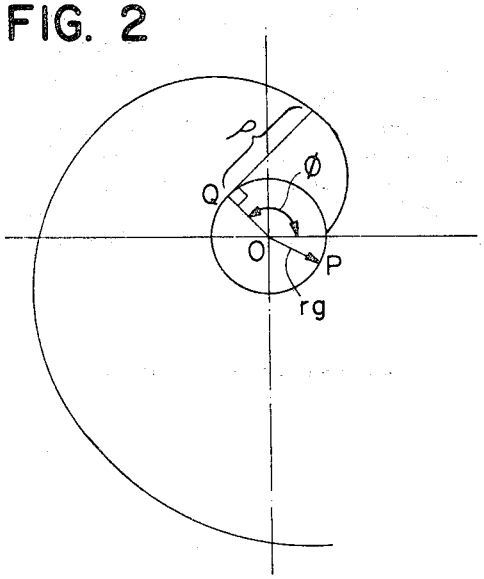
FIG. 2 is a diagram illustrating the properties of an involute of a circle.
Figure 3:
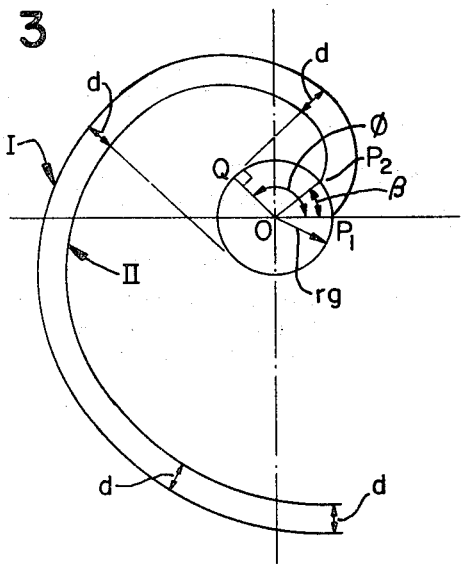
FIG. 3 is a diagram of two involutes illustrating the basic properties of an involute wrap of a scroll.

Generally, a side wall of the spiral element of a scroll follows an involute of a circle such as shown in FIG. 2. This involute is formed by beginning at starting point P of the generating circle and tracing the involute from the end of an inextensible string unwinding from point P. The curvature of the involute, i.e., the length $\rho$ along a tangent from the generating circle to the intersection of the involute, is given by $\rho=\phi\cdot rg$, where $\phi$ is the involute angle and rg is the radius of the generating circle. FIG. 3 illustrates two involutes, one involute I starts at point $P_1$ on the generating circle, and the other involute II starts at point $P_2$ on the generating circle. Point $P_2$ is located at an angular offset of $\rho$ from point $P_1$. Since, length $L_1$ along the tangent from the generating circle to the intersection of involute I is given by $L_1=\phi\cdot rg$ and length $L_2$ along the tangent from the generating circle to intersection of involute II is given by $L_2=(\phi-\beta)\cdot rg$, the distance d between both involutes I and II is given by $d=L_1-L_2=\phi\cdot rg-(\phi-\beta)\cdot rg=\beta\cdot rg$. Thus, the distance between involutes I and II is uniform and is not influenced by the involute angle at which the distance is measured.

Figure 4:
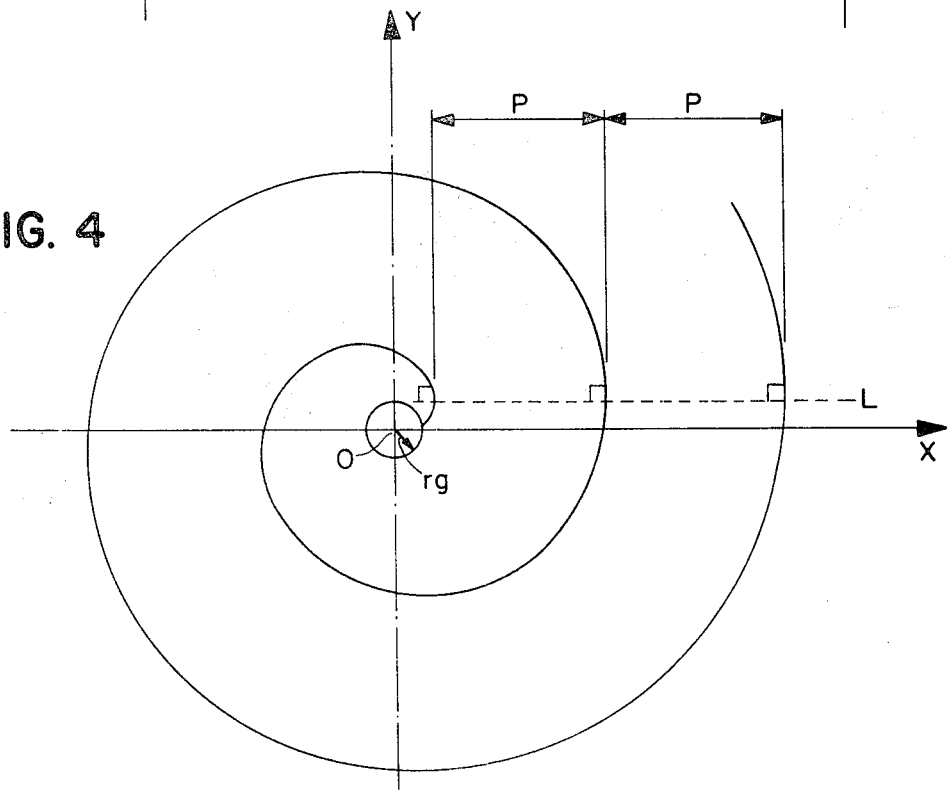
FIG. 4 is a diagram illustrating another property of an involute of a circle.

FIG. 4 illustrates another property of the involute of a circle. A line L is drawn tangent to the generating circle and intersects the involute surface at a plurality of points. The distance between these points of intersection is uniform and defines the pitch P of the involute. The pitch P is thus periodic and defined by $P=\pi\cdot rg$.

Figure 5:
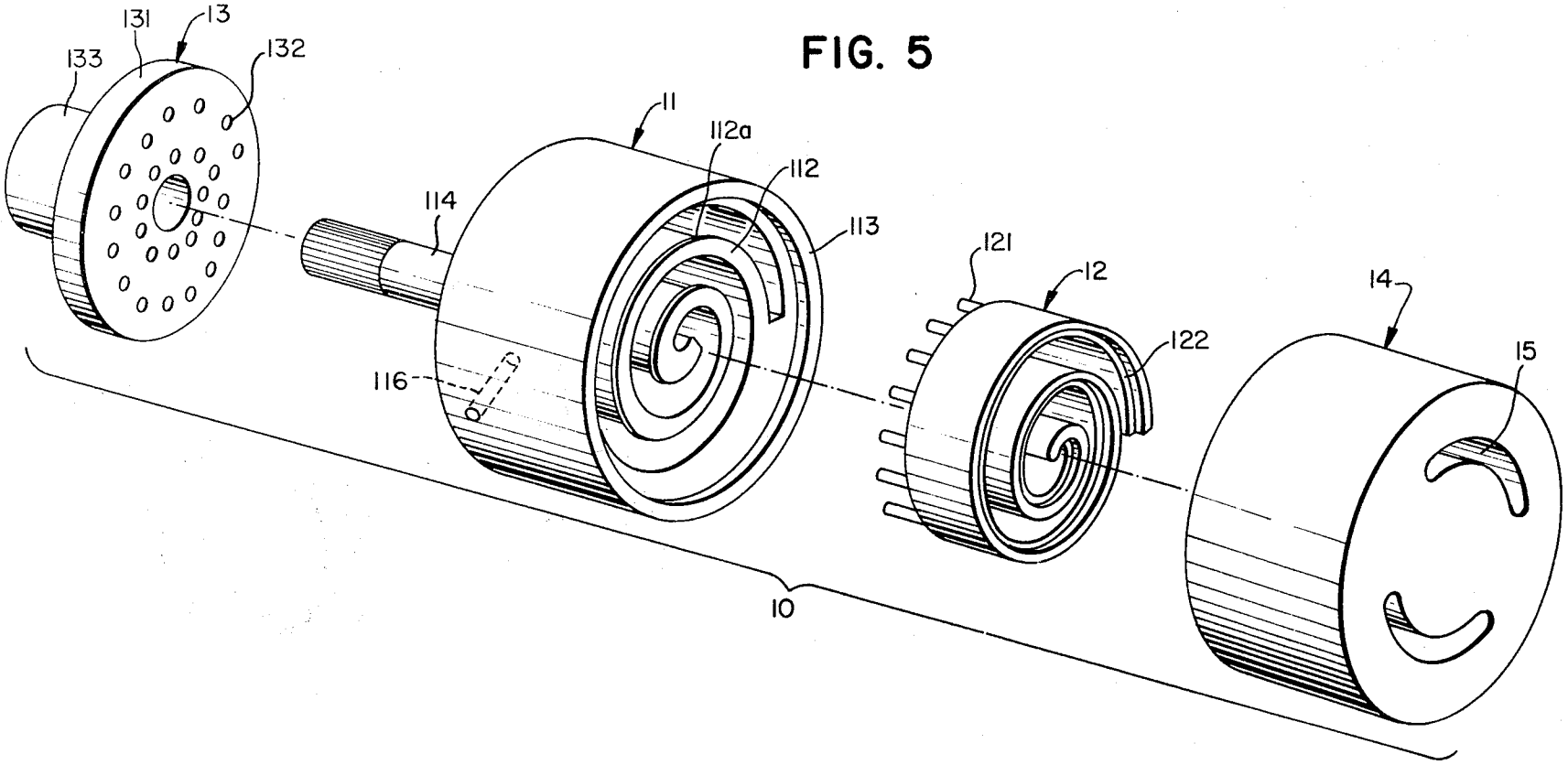
FIG. 5 is an exploded perspective view of a manufacturing tool according to the present invention.
Figure 6:
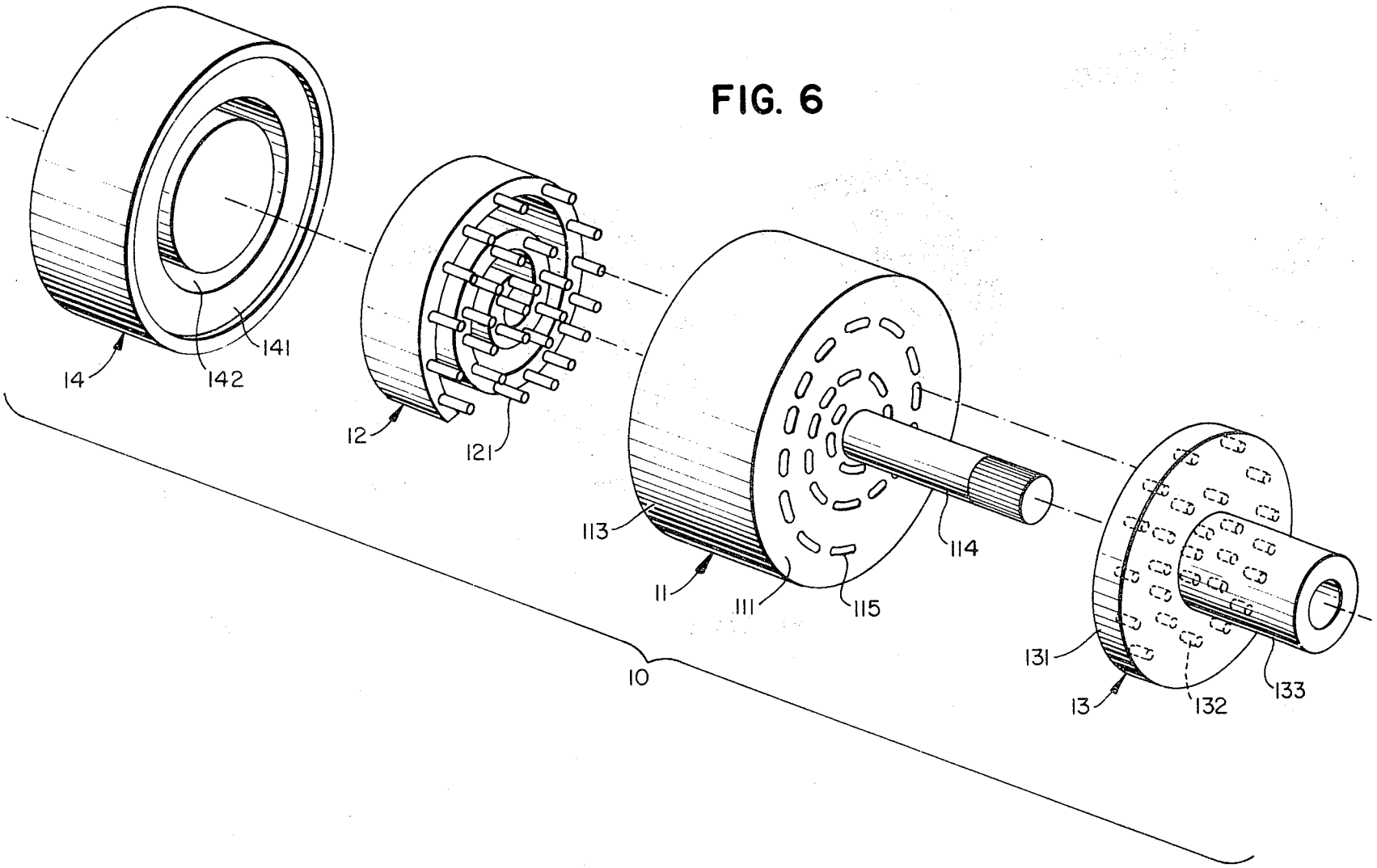
FIG. 6 is an exploded perspective view of the opposite side of the manufacturing tool of FIG. 5.

Referring to FIGS. 5 and 6, a manufacturing tool to form a scroll in accordance with the present invention is shown. Tool 10 includes a mold which includes first molding member 11 having first involute element 112, second involute element 12 having a plurality of pins 121 projecting from one axial end surface, rotatable member 13 and second molding member 14 having opening 141 for pouring.

First molding member 11 includes circular end plate 111, tubular outside wall 113 extending from the outer peripheral portion of end plate 111, a first involute element 112 affixed to or extending from one end surface of end plate 111 into the inner space of tubular outside wall 113 and a drive shaft 114 extending from the other end surface of end plate 111. The axial end surface of first involute element 112 has a radial flange portion **112*a* which extends along the outer side wall of first involute element 112. A plurality of arc shaped holes 115 are formed through end plate 111 along the outer side wall of first involute element 112. The outer and inner side walls of each arch shaped hole 115 consist of an arc shaped curve, the center of which is concentric with the center of first involute element 112. In this embodiment, a vent hole 116 is formed through tubular outside wall 113 as shown in FIG 5. Second involute element 12 is rotatably coupled to first molding member 11 by pins 121 which extend through holes 115. The axial end surface of second involute element 12 which faces the radial flange portion 112*a* has a cutout portion 122 which extends along the inner side wall of second involute element 12**.

Rotatable member 13 includes circular plate 131. A plurality of holes 132 extend into one end surface of circular plate 131 and tubular shaft 133 extends from the other end surface of circular plate 131. The axial end portions of pins 121, which extend through holes 115 of end plate 111, are received in holes 132 of circular plate 131. Tubular shaft 133 has a hole at its center for rotatably supporting drive shaft 113 of first molding member 11.

Second molding member 14 is placed over the first molding member 11 to close the opening at the end of both involute elements 112 and 12. The end surface of second molding member 14 which faces first molding member 11 has circular indentation 141 as shown in FIG. 6. Indentation 141 forms a molding space. At least one opening 15 for pouring is formed through second molding member 14. In this embodiment, as shown in FIGS. 5 and 6, two openings 15 for pouring are formed in second molding member 14 and annular intermediate space 142 connects opening 15 with indentation 141.

In this tool, the curve of second involute element 12 is formed in the same direction as the curve of first involute element 112 and both involute elements 112 and 12 interfit with a radial gap defined between the facing side wall of the involute elements to form the molding space. The radial flange **112*a* of first involute element 112 is disposed on cutout portion 122 of second involute element 12. A small gap separates radial flange 112*a* and the axial side wall of cut-out portion 122. Each pin 121 of second involute element 12 extends through hole 115 of end plate 111 so that pins 122 are movable in the arc shaped direction of holes 115. An axial end portion of each pin 121 which extends beyond hole 115 fits into hole 132 of rotatable member 13. Therefore, second involute element 12 can be moved relative to first involute element 122 by the rotation of rotatable member 13 because pins 121 can move in the arc shaped direction of holes 115. However, the magnitude of the rotation angle of second involute element 12, i.e., the amount which involute element 12 can rotate with respect to first involute element 112, is limited by the boundaries of arc shaped holes 115, since pins 121 of second involute element 12 penetrate the arc shaped holes 115. Similarly, while first molding member 11 can be rotated, the magnitude of the rotation angle of first molding member 11 also is limited by the boundaries of arc shaped holes 115. Thus, first molding member 11 and second involute element 12 can rotate in opposite directions within a limited angle which is defined by the length of arc shaped holes 115. The first and second molding members 11 and 14** are connected by a fastener, such as bolts and nuts (not shown).

Figure 7:
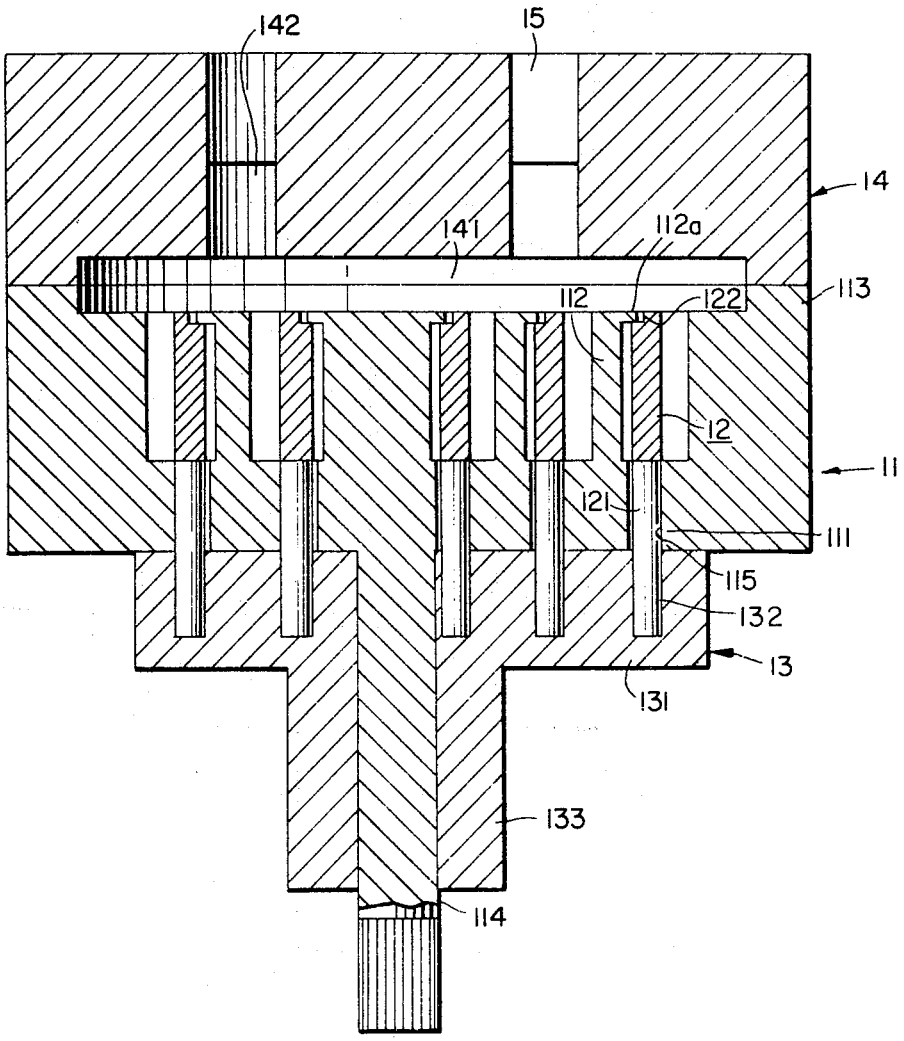
FIG. 7 is a sectional view of the assembled manufacturing tool of FIG. 5.
Figure 8:
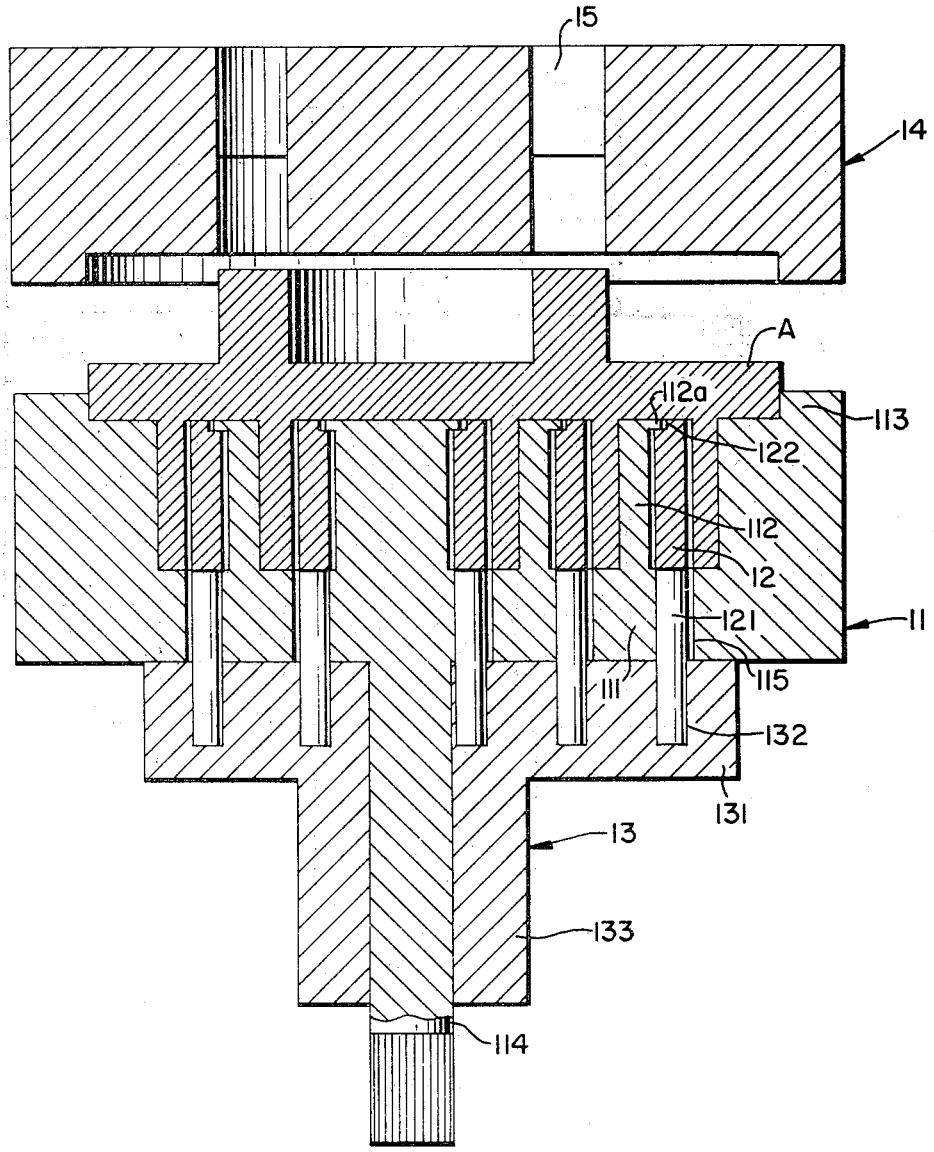
FIG. 8 is a sectional view of the manufacturing tool illustrating the process for removing the scroll.

A casting method using the above tool now will be explained with reference to FIGS. 7 and 8. As the first step, second involute element 12 is placed on first molding member 11 so that involute elements 112 and 12 interfit with a radial gap which forms the molding space. Also, rotatable member 13 is located along the end surface of end plate 111 so that pins 121 of second involute element 12 extend into holes 132 of circular plate 13. Second molding member 14 then is placed on first molding member 11 and connected to first molding member 11 by bolts and nuts (not shown) as shown in FIG. 7.

Molten metal, for example, aluminum, is poured into the radial gap defined by involute elements 112 and 12 through opening 15. The radial gap between the inner side wall of first involute element 112 and the outer side wall of second involute element 12, and the molding space of circular indentation 141, are filled with the molten metal which thereafter cools and solidifies.

After solidification of the molten metal, the connection between first and second molding members 11 and 14 is released and second molding member 14 is removed from first molding member 11. Rotatable member 13 then is rotated to rotate second involute element 12 so that the radial gap between the inner side wall of first involute element 112 and the outer side wall of second involute element 12 is slightly enlarged. The removal of the solidified metal, i.e., the preformed scroll, is readily accomplished, since the gap between the preformed scroll and first and second involute elements 112 and 12 is slightly enlarged and any bonds that may have formed between the preformed scroll and the first and second involute elements are broken due to the rotation of second involute element 12 through rotatable member 13. It has been found that even if the gap separating radial flange 112*a* of the first involute element 112 and cutout portion 122 of second involute element 12 is partially filled with solidified metal, there is still sufficient flexibility to permit movement by rotatable member 13 to enlarge the radial gap.

The preformed scroll made by the above method and tool is machined in a finishing process, such as milling, to produce the final scroll which is used in a scroll type fluid displacement apparatus.

As described above, in this invention, the draft angle of the mold for the spiral element can be minimized. As a result, the production of large quantities of waste metal during the finishing work on the preformed scroll is reduced. Furthermore, the time and energy for finishing or final machining of the scroll is greatly reduced without adversely influencing the accuracy of the spiral element dimensions.

This invention has been described in detail in connection with the preferred embodiment, but this is an example only and the invention is not restricted thereto. It will be easily understood by those skilled in the art that other variations and modifications can be easily made within the scope of this invention.

We claim:

1. A method for manufacturing a scroll for use in a scroll type fluid displacement apparatus, said scroll being formed by a spiral element and an end plate, the method comprising the steps of:

(a) providing a mold comprising: a first molding member having an end plate, a first involute element having an inner side wall and an outer side wall extending from one end surface of said end plate a tubular outside wall extending from one end surface of said end plate to enclose said first involute element, and a plurality of arc shaped holes formed in said end plate and placed along the outer side of said first involute element; a second involute element having an inner side wall and an outer side wall rotatably coupled to said molding member through a plurality of pins projecting from an axial end of said second involute element to form a radial gap defined by the inner side wall of said first involute element and the outer side wall of said second involute element; and a rotatable member disposed along the end surface of said end plate and coupled to said pins to transmit the rotation thereof to said second involute element;

(b) filling said radial gap with molten metal and allowing the molten metal to solidify;

(c) rotating said second involute element via said rotatable member to enlarge said radial gap; and (d) removing the solidified metal which has been formed into the shape of a spiral element from said radial gap.

2. The method of claim 1 wherein said mold further comprises a second molding member with an end surface having an indentation within which the end plate of the scroll is formed, said second molding member being placed over said first molding member.

3. The method of claims 1 or 2 wherein said first molding member has a tubular outside wall having a length larger than the length of said first and second involute elements to form the molding space within which part of the end plate of the scroll is formed.

4. The method of claim 1 wherein the metal forming process is a casting process.

5. A manufacturing tool for making a scroll for use in a scroll type fluid displacement apparatus, said scroll being formed by a spiral element and an end plate, said tool comprising:

(a) a first molding member having an end plate, a first involute element having an inner side wall and an outer side wall extending from one end surface of said end plate, a tubular outside wall extending from one end surface of said end plate to enclose said first involute element, and a plurality of arc shaped holes formed through said end plate and placed along the outer side of said first involute element;

(b) a second involute element having an inner side wall and an outer side wall rotatably coupled to said first molding member and interfitting with said first involute element in a disposition to define a radial gap between the inner side wall of said first involute element and the outer side wall of said second involute element, said second involute element having a plurality of pins projecting axially from an axial end of said second involute element and penetrating through said arc shaped holes in said end plate of said first molding member;

(c) a rotatable member having a plurality of holes extending in the axial direction, said pins of said second involute element having axial end portions extending into said holes in said rotatable member to couple said rotatable member to said second involute element and to transmit the rotation of said rotatable member to said second involute element so that the relative rotation between said first and second involute elements adjusts the size of said radial gap; and (d) a second molding member having an indentation in its axial end surface facing said first and second involute elements, said second molding member being attachable to said first molding member during the manufacturing process to define a space within which the end plate of the scroll is formed.

6. The manufacturing tool of claim 5 wherein a hollow tube extends from said rotatable member and a shaft extends from the end plate of said first molding member, said shaft extending into and being rotatable relative to said hollow tube.

7. The manufacturing tool of claim 5 wherein the length of said outside wall of said first molding member is larger than the length of said first and second involute elements to form a circular indentation within which a part of the end plate of the scroll is formed.

8. The manufacturing tool of claim 7 wherein a radial flange extends along an axial end portion of said first involute element and a cut-out portion extends along an axial end portion of said second involute element, said radial flange being disposed in said cut-out portion with a gap between said radial flange and an axial side wall of said cut-out portion.

* * * * *